United States Patent [19]

Stolfa

[11] 4,040,943

[45] Aug. 9, 1977

[54] COMBINATION THERMAL CRACKING AND COKING PROCESS

[75] Inventor: Frank Stolfa, Park Ridge, Ill.

[73] Assignee: UOP Inc., Des Plaines, Ill.

[21] Appl. No.: 701,327

[22] Filed: June 30, 1976

[51] Int. Cl.[2] ..... C10B 55/00; C10G 9/14; C10G 37/02

[52] U.S. Cl. ..... 208/80; 208/54; 208/78; 208/95

[58] Field of Search ..... 208/80, 78, 54, 67, 208/77, 93

[56] References Cited

U.S. PATENT DOCUMENTS

| | | | |
|---|---|---|---|
| **3,472,761** | 10/1969 | Cameron | 208/131 |
| 3,547,804 | 12/1970 | Noguchi et al. | 208/46 |
| 3,907,664 | 9/1975 | Janssen et al. | 208/80 |

*Primary Examiner*—Delbert E. Gantz
*Assistant Examiner*—G. E. Schmitkons
*Attorney, Agent, or Firm*—James R. Hoatson, Jr.; Thomas K. McBride; William H. Page, II

[57] ABSTRACT

A combination thermal cracker and coker for making specialty coke which permits high combined feed ratios necessary for total conversion to normally gaseous hydrocarbons, gasoline and coke without overloading the coke chamber with vapors. The process permits the use of smaller diameter coke chambers and/or lower pressure coke chambers.

3 Claims, 1 Drawing Figure

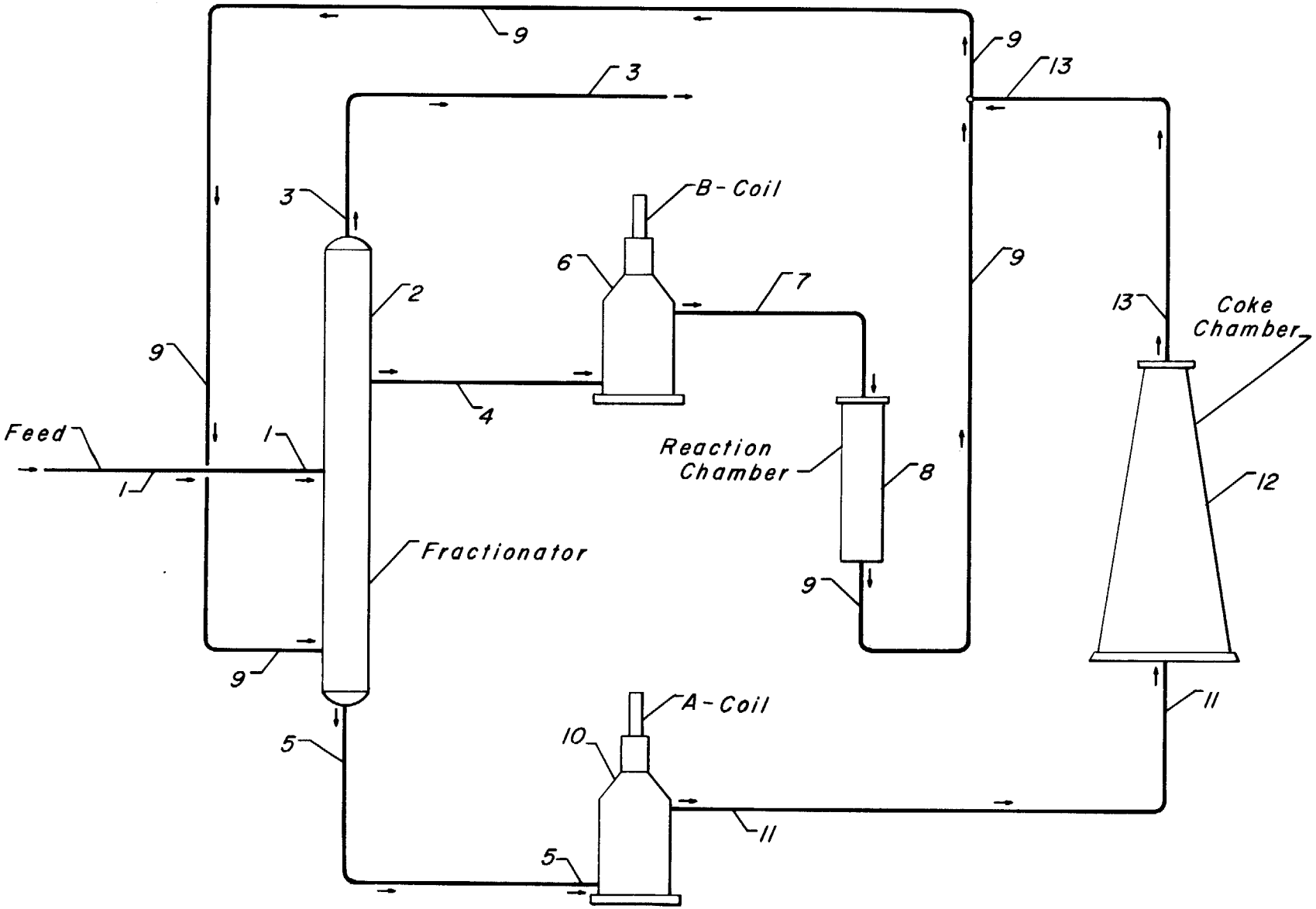
Coke Chamber
12
11
13
13
9
9
8
9
7
B-Coil
Reaction Chamber
A-Coil
11
3
6
10
5
9
4
Fractionator
2
3
5
1
9
9
1
Feed

COMBINATION THERMAL CRACKING AND COKING PROCESS

The invention herein described is adaptable to a process for the conversion of hydrocarbonaceous charge stocks, and, in particular, those charge stocks broadly categorized in the art as "black oils". More specifically, my invention is intended for use in effecting thermal cracking of heavy hydrocarbonaceous feed stocks and production of specialty coke. Atmospheric tower bottoms products, vacuum tower bottom products, crude oil residuum, coal oil extracts, topped crude oils and tar sand oil extracts, etc., all illustrative, but not limiting, of those black oils which can be processed in accordance with the present invention.

Black oils contain exceedingly large amounts of high molecular weight sulfurous and nitrogenous compounds. In addition, these heavy hydrocarbonaceous mixtures contain significant quantities of hydrocarbon-insoluble asphaltics and organo-metallic compounds principally comprising iron, nickel and vanadium. Currently, an abundant supply of such material exists, most of which has a gravity less than about 30° API and a boiling range which indicates that 10 percent by volume, or more, boils above a temperature of 1050° F. The abundant supply virtually demands conversion to satisfy the steadily increasing need for lower-boiling hydrocarbon products and especially coke. Illustrative of those charge stocks above described, is a residuum having a gravity of 27° API and containing 0.17 weight percent sulfur and about 13 ppm. of total metals.

The principal difficulty, accompanying the conversion of black oils, stems from the presence of asphaltic material and the organo-metallic complexes. Fixed bed catalytic processes, although advantageously used in a myriad of hydrocarbon conversion precesses, are unsuited for use in black oil processing due to the rapid deposition of coke onto the catalytic composite, and the extremely short period of successful onstream operation until the catalyst "picks up" metal contaminants equal to its own weight.

Other suitable charge stocks which may be processed according to the method of this invention include reduced crude oil, atmospheric and vacuum gas oils, coker gas oils, fluid catalytic cracker slurry oil, furfurol extract, pyrolysis residue and any other charge stocks used for the production of specialty cokes.

The principal object of the present invention is to convert hydrocarbonaceous feed stocks to more useful and valuable products. More specifically, it is an object of this invention to produce gasoline and specialty coke from hydrocarbonaceous feed stocks.

The objects are accomplished through the utilizaton of one embodiment which comprises a process for the thermalcracking and coking of a hydrocarbonaceous charge stock which comprises: (a) introducing said charge stock into a fractionator maintained at conditions to yield a gasoline stream, a light gas oil stream and a bottoms stream; (b) introducing said light gas oil stream into a first thermal cracking coil; (c) tranferring the first thermal cracking coil effluent stream to said fractionator; (d) introducing said bottoms stream into a second thermal cracking coil; (e) transferring the second thermal cracking effluent stream to a coke chamber; and (f) returning the coke chamber effluent stream to said fractionator.

Other embodiments of my invention are concerned with preferred product distributions and operating conditions. These, as well as other objects, will become evident, to those having expertise in the art, from the following more detailed description.

When a given hydrocarbonaceous feedstock is selected for processing it may be desirable when practicing the process of the present invention to incorporate a reaction chamber in the transfer line between the light distillate thermal cracking coil and the fractionator as exemplified in the drawing. Although the inclusion of such a reaction chamber is not critical, the obtention of a given product distribution may require the inclusion of a reaction chamber in the flow scheme.

In order to compete with newer hydroprocessing techniques, combination thermal cracker-cokers must utilize more advanced methods while retaining the basic and proven advantages of the cracker-coker art. As sources of energy become more scarce and therefore more expensive, it becomes imperative that all energy sources be utilized and up-graded to the maximum. Since black oil and other heavy distillates are less desirable portions of the petroleum crude oil, the up-grading and utilization of these materials becomes increasingly important. Thermal crackers and cokers have always been used to convert black oils but in recent times the production of maximum quantities of gasoline together with quality, specialized coke has become even more desirable.

I have discovered an improved method for total conversion to gas, gasoline and specialty coke without overloading the coke chambers with vapors. My improved method comprises by-passing the light oil heater-reaction chamber effluent around the coke chamber and passing said effluent directly to the fractionator. The thermal tar present in the reaction chamber effluent is recycled to the "A" coil with the fresh feed and then to the coke chamber to contribute to the total coke produced. The light gas oil in the reaction chamber effluent plus the light gas oil generated in the "A" coil after fractionation is recycled to the "B" coil and the gas and gasoline are removed overhead from the fractionator. This type of operation permits the high combined feed ratios necessary for total conversion at reasonable coke chamber vapor velocities. Operation with my invention permits the use of smaller diameter coke chambers and/or lower pressure chambers.

The preferred operating conditions for the thermal cracking coils include a temperature of from about 250° F. to about 1050° F. and a pressure from about 5 to about 700 psig.

In further describing the present invention, reference will be made to the accompanying drawing which is presented for the sole purpose of illustration. Thus, miscellaneous appertenances, including valves, controls, instruments, pumps, heat exchangers, start-up lines and heat recovery circuits have been eliminated. The use of this type of conventional hardware is well within the purview of those skilled in the techniques of petroleum refining and processing.

The drawing is representative of a simplified schematic flow diagram.

With reference now to the drawing, a black oil charge stock, following heat exchange with hot effluent, which technique is not illustrated, is introduced through line 1 into fractionator 2. the temperature in fractionator 2 is maintained at a temperature and pressure, determined according to the feed composition, to yield a gasoline stream via line 3, a heavy distillate stream via line 4 and a black oil stream via line 5. The heavy distillate stream is introduced into "B" coil 6 via line 4 which coil is maintained at a maximum temperature of about 980° F. The effluent from "B" coil 6 is transferred to reaction chamber 8 via line 7. Reaction chamber 8 is maintained at a pressure of about 325 psig. The effluent from reaction chamber 8 is introduced into fractionator 2 via line 9. The black oil stream is introduced into "A" coil 10 via line 5 which coil is maintained at a maximum temperature of about 950° F. The effluent from "A" coil 10 is transferred to coke chamber 12 via line 11. Coke chamber 12 is maintained at a pressure of about 60 psig. The effluent from coke chamber 12 is introduced into fractionator 2 via line 13 and via line 9.

The following example is presented in illustration of the instant invention and is not intended as an undue limitation on the generally broad scope of the invention as set out in the appended claims.

EXAMPLE

A conventional prior art thermal cracker-coker is used to process 14,000 barrels per day of a reduced crude having an API of 27° and containing 0.17 wt.% sulfur and 13 ppm. total metals. The products are recovered and the distribution of the coke chamber effluent is presented in Column A, Table I. A processing scheme as exemplified in the drawing is also utilized to process 14,000 barrels per day of reduced crude as described hereinabove. The products are recovered and the distribution of the coke chamber effluent is presented in Column B, Table I.

From Table I, it is apparent that the effluent from the coke chamber is significantly less when using the method of the present invention which produces resulting economics of operation.

Table I

| COKE CHAMBER EFFLUENT | DISTRIBUTION | | | |
|---|---|---|---|---|
| | A | | B | |
| PRODUCT | Total wt. % Fresh Feed | Vapor, Mols/Hr. | Total wt. % Fresh Feed | Vapor, Mols/Hr |
| Hydrogen Sulfide | 0.1 | 5 | 0.1 | 5 |
| $C_4$-minus | 26.7 | 1286 | 10.7 | 514 |
| $C_5$-400° F. | 55.7 | 846 | 22.2 | 338 |
| Coke | 17.5 | — | 17.5 | — |
| "A" coil recycle | 100 | 468 | 100 | 468 |
| "B" coil recycle | 280 | 2454 | — | — |
| | 480 | 5059 | 1505 | 1325 |

The foregoing specification and example clearly illustrate the improvements encompassed by the present invention and the benefits to be afforded a process for the production of gasoline and specialty coke from hydrocarbonaceous oils.

I claim as my invention:

1. A process for the conversion of black oil containing high molecular weight sulfurous and nitrogenous compounds and hydrocarbon-insoluble asphaltic and organo-metallic compounds, and having an end boiling point above 1050° F., which comprises;

a. introducing said black oil at an intermediate point in the height of a fractionator and removing from the fractionator an overhead gasoline stream, an intermediate heavy distillate stream and a bottoms stream;

b. passing said heavy distillate stream through a first thermal cracking coil and a reaction chamber and therein cracking the same;

c. passing said bottoms stream through a second thermal cracking coil and thence into a coke chamber and separating vapors from coke in said chamber;

d. commingling the vapors from the coke chamber with the effluent from said reaction chamber; and e. introducing the resultant mixture to the lower portion of said fractionator at a point below the point of introduction of said black oil thereto.

2. The process of claim 1 further characterized in that said first thermal cracking coil is maintained at a temperature in the range from about 900° F. to about 1000° F. and a pressure in the range from about 250 psig. to about 500 psig.

3. The process of claim 1 further characterized in that said second thermal cracking coil is maintained at a temperature in the range from about 875° F. to about 950° F. and a pressure in the range from about 15 psig. to about 100 psig.

* * * * *